US010993292B2

(12) United States Patent
Baldo et al.

(10) Patent No.: US 10,993,292 B2
(45) Date of Patent: Apr. 27, 2021

(54) SYSTEM AND METHOD FOR TUNING AN INDUCTION CIRCUIT

(71) Applicant: WHIRLPOOL CORPORATION, Benton Harbor, MI (US)

(72) Inventors: Salvatore Baldo, Grotte (IT); Stefano Moroni, Laveno Mombello (IT); Davide Parachini, Cassano Magnago (IT); Cristiano Vito Pastore, Camerio (IT); Gioacchino Prestigiacomo, Palermo (IT)

(73) Assignee: Whirlpool Corporation, Benton Harbor, MI (US)

( * ) Notice: Subject to any disclaimer, the term of this patent is extended or adjusted under 35 U.S.C. 154(b) by 579 days.

(21) Appl. No.: 15/790,414

(22) Filed: Oct. 23, 2017

(65) Prior Publication Data

US 2019/0124725 A1 Apr. 25, 2019

(51) Int. Cl.
*H05B 6/06* (2006.01)
*H05B 6/12* (2006.01)
*H05B 6/08* (2006.01)

(52) U.S. Cl.
CPC ..... *H05B 6/065* (2013.01); *H05B 6/062* (2013.01); *H05B 6/08* (2013.01); *H05B 6/1209* (2013.01)

(58) Field of Classification Search
CPC ..... H05B 6/065; H05B 6/1209
USPC ..... 219/660, 662, 625, 624, 626, 665, 676; 363/40, 41, 69, 71, 80; 323/275, 276, 323/277
See application file for complete search history.

(56) References Cited

U.S. PATENT DOCUMENTS 3,259,837 A 7/1966 Oshry
3,475,674 A * 10/1969 Porterfield ..... H05B 6/06 363/136
3,515,938 A * 6/1970 Morse ..... H01S 3/092 315/240
3,761,667 A * 9/1973 Walden ..... H05B 6/1281 219/625
3,814,888 A * 6/1974 Bowers ..... A47J 36/2483 219/624

(Continued)

FOREIGN PATENT DOCUMENTS

CN 2822091 Y 9/2006
CN 102396294 A 3/2012

(Continued)

OTHER PUBLICATIONS

Sarnago et al., "Multiple-Output ZCS Resonant Inverter for Multi-Coil Induction Heating Appliances," IEEE 2017, pp. 2234-2238.

(Continued)

*Primary Examiner* — Jimmy Chou
(74) *Attorney, Agent, or Firm* — Price Heneveld LLP

(57) ABSTRACT

The present disclosure relates to an induction cooktop. The induction cooktop comprises a ceramic cooking surface in connection with a housing. A plurality of inductors is disposed in the housing and each of the inductors is in communication with an automatic control system. The automatic control system is configured to check for the presence of a cooking pan on the cooktop in order to prevent the inductors from activating in the absence of the cooking pan. The automatic control system is activated upon receiving an activation command.

14 Claims, 7 Drawing Sheets

(56) References Cited

U.S. PATENT DOCUMENTS 3,820,005 A * 6/1974 Steigerwald ..... G05F 1/44 363/96
3,842,338 A * 10/1974 Walden ..... H05B 6/1281 363/124
3,942,090 A * 3/1976 Matthes ..... H02M 5/4505 363/37
4,029,926 A 6/1977 Austin
4,092,510 A * 5/1978 Kiuchi ..... H02M 7/523 219/624
4,114,010 A * 9/1978 Lewis ..... G01R 31/00 219/660
4,129,767 A * 12/1978 Amagami ..... H05B 6/062 219/624
4,149,217 A * 4/1979 Tucker ..... H05B 6/062 219/492
4,220,839 A 9/1980 De Leon
4,347,424 A * 8/1982 Obara ..... B23H 1/022 219/69.13
4,356,371 A 10/1982 Kiuchi et al.
4,415,788 A 11/1983 Field
4,431,892 A 2/1984 White
4,438,311 A 3/1984 Tazima et al.
4,476,946 A 10/1984 Smith
4,540,866 A 9/1985 Okuda
4,578,553 A * 3/1986 Yamashita ..... H05B 6/06 219/625
4,629,843 A 12/1986 Kato et al.
4,644,123 A * 2/1987 Kerlin ..... B23H 9/00 219/68
4,695,770 A 9/1987 Raets
4,713,528 A 12/1987 Hirata
4,749,836 A * 6/1988 Matsuo ..... H05B 6/062 219/626
4,776,980 A 10/1988 Ruffini
4,810,847 A 3/1989 Ito
4,820,891 A 4/1989 Tanaka et al.
5,190,026 A 3/1993 Doty
5,272,719 A * 12/1993 Cartlidge ..... F27B 14/061 219/662
5,523,631 A 6/1996 Fishman et al.
5,571,438 A 11/1996 Izaki et al.
5,640,497 A 6/1997 Woolbright
5,665,263 A 9/1997 Gaspard
5,686,006 A 11/1997 Gaspard
5,808,280 A 9/1998 Gaspard
5,841,646 A * 11/1998 Cornec ..... H02M 7/53803 363/56.08
5,866,884 A 2/1999 Cornec et al.
6,018,154 A 1/2000 Izaki et al.
6,078,033 A 6/2000 Bowers et al.
6,230,137 B1 5/2001 Has et al.
6,466,467 B2 * 10/2002 Lehuede ..... H02M 7/5387 363/132
6,693,262 B2 2/2004 Gerola et al.
6,696,770 B2 2/2004 Nadot et al.
6,764,277 B2 7/2004 Somahara et al.
7,021,895 B2 4/2006 Rubenstein et al.
7,023,246 B2 4/2006 Scollo et al.
7,049,563 B2 5/2006 Keishima et al.
7,053,678 B2 5/2006 Scollo et al.
7,057,144 B2 6/2006 Hirota et al.
7,274,008 B2 9/2007 Arnal Valero et al.
7,306,429 B2 12/2007 Horng et al.
7,361,870 B2 * 4/2008 Cornec ..... H02M 7/53803 219/660
7,369,421 B1 * 5/2008 Chan ..... H02M 7/5387 363/132
7,390,994 B2 6/2008 Oh et al.
7,429,021 B2 9/2008 Sather et al.
7,504,607 B2 3/2009 Barragan Perez et al.
7,709,732 B2 5/2010 Phillips
7,759,616 B2 7/2010 Gouardo et al.
7,777,163 B2 8/2010 Hosoi et al.
7,786,414 B2 8/2010 Schilling et al.
7,910,865 B2 3/2011 Haag et al.
7,982,570 B2 7/2011 Burdick, Jr. et al.
8,017,864 B2 9/2011 Phillips
8,248,145 B2 8/2012 Melanson
8,263,916 B2 9/2012 Fujita et al.
8,324,541 B2 * 12/2012 Shirokawa ..... H05B 6/666 219/715
8,350,194 B2 1/2013 Lee et al.
8,356,367 B2 1/2013 Flynn
8,431,875 B2 4/2013 Gutierrez
8,440,944 B2 5/2013 Acero Acero et al.
8,558,148 B2 10/2013 Artigas Maestre et al.
8,618,778 B2 12/2013 Gray et al.
8,658,950 B2 2/2014 Cho et al.
8,723,089 B2 5/2014 Sadakata et al.
8,742,299 B2 6/2014 Gouardo et al.
8,754,351 B2 6/2014 England et al.
8,791,398 B2 7/2014 De la Cuerda Ortin et al.
8,817,506 B2 8/2014 Shimomugi et al.
8,853,991 B2 10/2014 Shan et al.
8,878,108 B2 11/2014 Kitaizumi et al.
8,901,466 B2 12/2014 Schilling et al.
8,912,473 B2 12/2014 Roux
8,975,931 B2 3/2015 Koehler
9,006,621 B2 4/2015 Artal Lahoz et al.
9,019,736 B2 * 4/2015 Lee ..... H02M 1/15 363/131
9,060,389 B2 6/2015 Lee et al.
9,084,295 B2 7/2015 Sadakata et al.
9,113,502 B2 8/2015 Falcon et al.
9,198,233 B2 11/2015 Brosnan et al.
9,269,133 B2 2/2016 Cho et al.
9,277,598 B2 3/2016 Lee et al.
9,282,593 B2 3/2016 Brosnan et al.
9,326,329 B2 4/2016 Kitaizumi et al.
9,347,672 B2 5/2016 Jungbauer et al.
9,356,383 B2 5/2016 Waffenschmidt et al.
9,370,051 B2 6/2016 Fossati et al.
9,374,851 B2 6/2016 Klein et al.
9,400,115 B2 7/2016 Kuwamura
9,491,809 B2 11/2016 Shaffer et al.
9,554,425 B2 1/2017 Sawada et al.
9,603,202 B2 3/2017 Shaw
9,609,697 B2 3/2017 Aldana Arjol et al.
9,622,296 B2 4/2017 Dehnert et al.
2003/0004647 A1 1/2003 Sinclair
2003/0163326 A1 8/2003 Maase
2005/0002784 A1 1/2005 Li et al.
2005/0087526 A1 * 4/2005 Kim ..... H05B 6/062 219/626
2005/0121438 A1 * 6/2005 Hirota ..... H05B 6/062 219/663
2006/0072353 A1 * 4/2006 Mhaskar ..... H02M 5/4585 363/80
2006/0209577 A1 * 9/2006 Hackner ..... H02M 3/156 363/39
2006/0289489 A1 12/2006 Wang
2007/0246458 A1 10/2007 Seok et al.
2009/0020526 A1 1/2009 Roux
2009/0084777 A1 4/2009 Oh et al.
2009/0272735 A1 * 11/2009 Suenaga ..... H05B 6/685 219/702
2009/0321424 A1 12/2009 Magdalena et al.
2010/0044367 A1 2/2010 Kim et al.
2010/0163546 A1 7/2010 Nanno et al.
2010/0182136 A1 7/2010 Pryor
2011/0051473 A1 * 3/2011 Glaser ..... H02M 3/1588 363/24
2011/0084058 A1 4/2011 Kim et al.
2011/0139771 A1 * 6/2011 Dohmeier ..... H05B 6/04 219/661
2011/0155200 A1 6/2011 Simka
2011/0168697 A1 * 7/2011 Kazama ..... H05B 6/04 219/660
2011/0240632 A1 * 10/2011 Anton Falcon ..... H05B 6/065 219/601
2011/0272397 A1 11/2011 Lahoz et al.

(56) References Cited

U.S. PATENT DOCUMENTS

2011/0303653 A1 12/2011 Chun et al.
2012/0024835 A1 2/2012 Artal Lahoz et al.
2012/0024842 A1 2/2012 Thomann et al.
2012/0037616 A1* 2/2012 Kitahara ..... H02M 7/53871 219/665
2012/0152935 A1* 6/2012 Kitaizumi ..... H05B 6/065 219/661
2012/0187107 A1* 7/2012 Liu ..... H02M 5/458 219/492
2012/0205365 A1* 8/2012 Anton Falcon ..... H05B 6/065 219/620
2012/0223070 A1 9/2012 Matsui et al.
2012/0248098 A1 10/2012 Lee et al.
2012/0261405 A1 10/2012 Kurose et al.
2012/0321762 A1 12/2012 Aranda Vazquez et al.
2013/0008889 A1* 1/2013 Ogasawara ..... H05B 6/062 219/622
2013/0043239 A1* 2/2013 Anton Falcon ..... H05B 6/062 219/620
2013/0087554 A1* 4/2013 Anton Falcon ..... H05B 6/065 219/622
2013/0206750 A1* 8/2013 Anton Falcon ..... H05B 6/062 219/622
2013/0248517 A1* 9/2013 Moon ..... H05B 6/1236 219/626
2013/0314953 A1* 11/2013 Cuzner ..... H02M 5/4585 363/37
2013/0334210 A1 12/2013 Takehira et al.
2013/0334212 A1* 12/2013 Sawada ..... H05B 6/065 219/662
2013/0334213 A1* 12/2013 Isoda ..... H05B 6/08 219/662
2014/0049996 A1* 2/2014 Ku ..... H02M 7/5388 363/71
2014/0104907 A1* 4/2014 Shimada ..... H02M 7/493 363/80
2014/0144902 A1* 5/2014 Oh ..... H05B 6/065 219/620
2014/0151365 A1* 6/2014 Oh ..... H05B 6/065 219/620
2014/0158679 A1* 6/2014 Moon ..... H05B 1/0266 219/660
2014/0177300 A1* 6/2014 Lagorce ..... H02M 7/4826 363/71
2014/0183182 A1* 7/2014 Oh ..... H05B 6/062 219/662
2014/0183183 A1* 7/2014 Oh ..... H05B 6/065 219/662
2014/0183184 A1* 7/2014 Oh ..... H05B 6/065 219/662
2014/0305928 A1 10/2014 Thompson et al.
2015/0245417 A1 8/2015 Fattorini et al.
2015/0341990 A1 11/2015 Nagata et al.
2016/0029439 A1* 1/2016 Kurose ..... H05B 6/1272 219/626
2016/0037584 A1 2/2016 Viroli et al.
2016/0037589 A1* 2/2016 Altamura ..... F24C 15/106 219/447.1
2016/0057814 A1* 2/2016 Klett ..... H05B 6/105 219/643
2016/0065049 A1* 3/2016 Wu ..... H02M 1/12 363/40
2016/0100460 A1* 4/2016 Park ..... H05B 6/065 219/624
2016/0100461 A1* 4/2016 Park ..... H05B 6/065 219/624
2016/0135255 A1 5/2016 Ogawa et al.
2016/0234889 A1 8/2016 Vazquez et al.
2016/0323937 A1* 11/2016 Anton Falcon ..... H05B 6/062
2016/0330799 A1 11/2016 Leyh et al.
2016/0374151 A1* 12/2016 Ok ..... H05B 1/0202
2016/0381735 A1 12/2016 Christiansen et al.
2017/0055318 A1 2/2017 Franco Gutierrez et al.
2017/0105251 A1 4/2017 Viroli et al.
2017/0142783 A1 5/2017 Herzog et al.
2017/0181229 A1 6/2017 Lomp et al.

FOREIGN PATENT DOCUMENTS

CN 103596307 A 2/2014
DE 7242625 U 3/1973
DE 3909125 A1 9/1990
DE 4228076 C1 8/1993
DE 19907596 A1 8/2000
DE 102004009606 A1 9/2005
DE 102007032757 A1 2/2008
DE 102007037881 A1 1/2009
DE 202009000990 U1 4/2009
DE 102010028549 A1 11/2010
DE 112008002807 B4 9/2013
DE 102013206340 A1 10/2014
DE 102014105161 A1 10/2015
DE 102015220788 A1 6/2016
DE 102015220795 A1 6/2016
EP 0498735 A1 8/1992
EP 0722261 A1 12/1995
EP 0713350 A1 5/1996
EP 1137324 A1 9/2001
EP 1629698 B1 5/2003
EP 1505350 A2 2/2005
EP 1610590 A1 12/2005
EP 0926926 B1 11/2006
EP 1455453 B1 9/2007
EP 2095686 B1 11/2007
EP 2352359 B1 1/2009
EP 2252130 B1 3/2009
EP 2070442 A2 6/2009
EP 1575336 B1 1/2010
EP 2642820 A1 11/2010
EP 2120508 B1 12/2010
EP 2506662 A1 10/2012
EP 2506674 A1 10/2012
EP 2615376 A1 7/2013
EP 2048914 B1 10/2013
EP 2744299 A1 6/2014
EP 2775785 A1 9/2014
EP 2211591 B2 10/2014
EP 1931177 B1 5/2015
EP 2034799 B1 5/2015
EP 2034800 B1 5/2015
EP 2204072 B1 7/2015
EP 2731402 B1 8/2015
EP 2975289 A2 1/2016
EP 1303168 B1 3/2016
EP 2445309 B1 5/2016
EP 2525485 B1 7/2016
EP 2543232 B1 7/2016
EP 2838316 B1 10/2016
EP 2427032 B1 12/2016
EP 2914059 B1 12/2016
EP 3170363 A1 5/2017
EP 3042541 B1 6/2017
EP 2416621 B1 7/2017
EP 3030042 B1 8/2017
EP 3139702 A1 8/2017
EP 3079443 B1 11/2017
ES 2201937 A1 3/2004
ES 2310962 A1 1/2009
ES 2328540 B1 9/2010
ES 2340900 B1 5/2011
ES 2362523 B1 8/2012
FR 2659725 A1 9/1991
FR 2712071 A1 5/1995
FR 2863039 A1 6/2005
FR 2965446 A1 3/2012
GB 2048025 B 1/1983
JP H07211443 A 8/1995
JP H07211444 A 8/1995
JP H08187168 A 7/1996
JP 2001196156 A 7/2001
JP 3225240 B2 11/2001

(56) References Cited

FOREIGN PATENT DOCUMENTS

| | | | |
|---|---|---|---|
| JP | 2008153046 | A | 7/2008 |
| JP | 2009099324 | A | 5/2009 |
| JP | 2009117378 | A | 5/2009 |
| JP | 2009158225 | A | 7/2009 |
| JP | 4932548 | B2 | 5/2012 |
| KR | 20170019888 | A | 2/2017 |
| WO | 9737515 | A1 | 10/1997 |
| WO | 2005069688 | A2 | 7/2005 |
| WO | 2008031714 | A1 | 3/2008 |
| WO | 2008122495 | A1 | 10/2008 |
| WO | 2009016124 | A1 | 2/2009 |
| WO | 2009049989 | A1 | 4/2009 |
| WO | 2009053279 | A1 | 4/2009 |
| WO | 2010101135 | A1 | 9/2010 |
| WO | 2011055283 | A1 | 5/2011 |
| WO | 2011128799 | A1 | 10/2011 |
| WO | 2011148289 | A2 | 12/2011 |
| WO | 2012104327 | A1 | 8/2012 |
| WO | 2014156010 | A1 | 10/2014 |
| WO | 2016010492 | A1 | 1/2016 |
| WO | 2016015971 | A1 | 2/2016 |
| WO | 2016071803 | A1 | 5/2016 |
| WO | 2016087297 | A1 | 6/2016 |
| WO | 2016134779 | A1 | 9/2016 |
| WO | 2017109609 | A1 | 6/2017 |
| WO | 2017115334 | A1 | 7/2017 |

OTHER PUBLICATIONS

Sarnago et al., "Modulation Scheme for Improved Operation of an RB-IGBT-Based Resonant Inverter Applied to Domestic Induction Heating," IEEE Transactions on Industrial Electronics, vol. 60, No. 5, May 2013, pp. 2066-2073.

* cited by examiner

SYSTEM AND METHOD FOR TUNING AN INDUCTION CIRCUIT

FIELD OF THE INVENTION

The present disclosure relates to an induction cooktop and, more particularly, to a circuit configuration and method of operation for an induction cooktop.

BACKGROUND

Induction cooktops are devices which exploit the phenomenon of induction heating for food cooking purposes. The disclosure provides for a power circuit for an induction cooktop configured to provide improved performance while maintaining an economical design. The improved performance may be provided by an increased range of operating power for induction cooktops. Accordingly, the disclosure provides for systems and methods of controlling the operating power of induction cooktops.

SUMMARY

According to one aspect of the present invention, an induction cooking system is disclosed. The system comprises a power supply bus and a plurality of resonant inverters in connection with the power supply bus. Each of the resonant inverters comprises a dedicated resonant capacitor. A plurality of inductors is in connection with the resonant inverters and configured to generate an electromagnetic field. At least one switch is operable to control a plurality of switch configurations. A tuning capacitor is in connection with each of the dedicated resonant capacitors via the at least one switch. The switch is configured to selectively connect the tuning capacitor in parallel with one of the dedicated resonant capacitors in each of the plurality of switch configurations.

According to another aspect of the present invention, a method for controlling an induction heating system is disclosed. The method comprises generating a direct current (DC) power from an alternating current (AC) power source and supplying the DC power to a first resonant inverter and a second resonant inverter via a power supply bus. The method further comprises controlling a switching frequency of each of the first resonant inverter and the second resonant inverter. In response to the switching frequency, an electromagnetic field is generated by a plurality of induction coils of the resonant inverters. The method further comprises selectively tuning the operation of either the first resonant inverter or the second resonant inverter.

According to yet another aspect of the present invention, an induction cooking system is disclosed. The system comprises a power supply bus, a first resonant inverter and a second resonant inverter. The first resonant inverter comprises a first dedicated resonant capacitor in connection with the power supply bus and a first induction coil is connected in parallel with the first dedicated resonant capacitor. The second resonant inverter comprises a second dedicated resonant capacitor in connection with the power supply bus and a second induction coil connected in parallel with the second dedicated resonant capacitor. The system further comprises at least one switch operable to control a plurality of switch configurations and a tuning capacitor. The tuning capacitor is in connection with the first dedicated resonant capacitor and the second dedicated resonant capacitor via the at least one switch. The at least one switch is configured to selectively connect the tuning capacitor in parallel to either the first dedicated resonant capacitor or the second dedicated resonant capacitor in each of the plurality of switch configurations.

These and other objects of the present disclosure may be achieved by means of a cooktop incorporating the features set out in the appended claims, which are an integral part of the present description.

BRIEF DESCRIPTION OF THE DRAWINGS

Further objects and advantages of the present disclosure may become more apparent from the following detailed description and from the annexed drawing, which is provided by way of a non-limiting example, wherein.

DETAILED DESCRIPTION OF EMBODIMENTS

Figure 1:
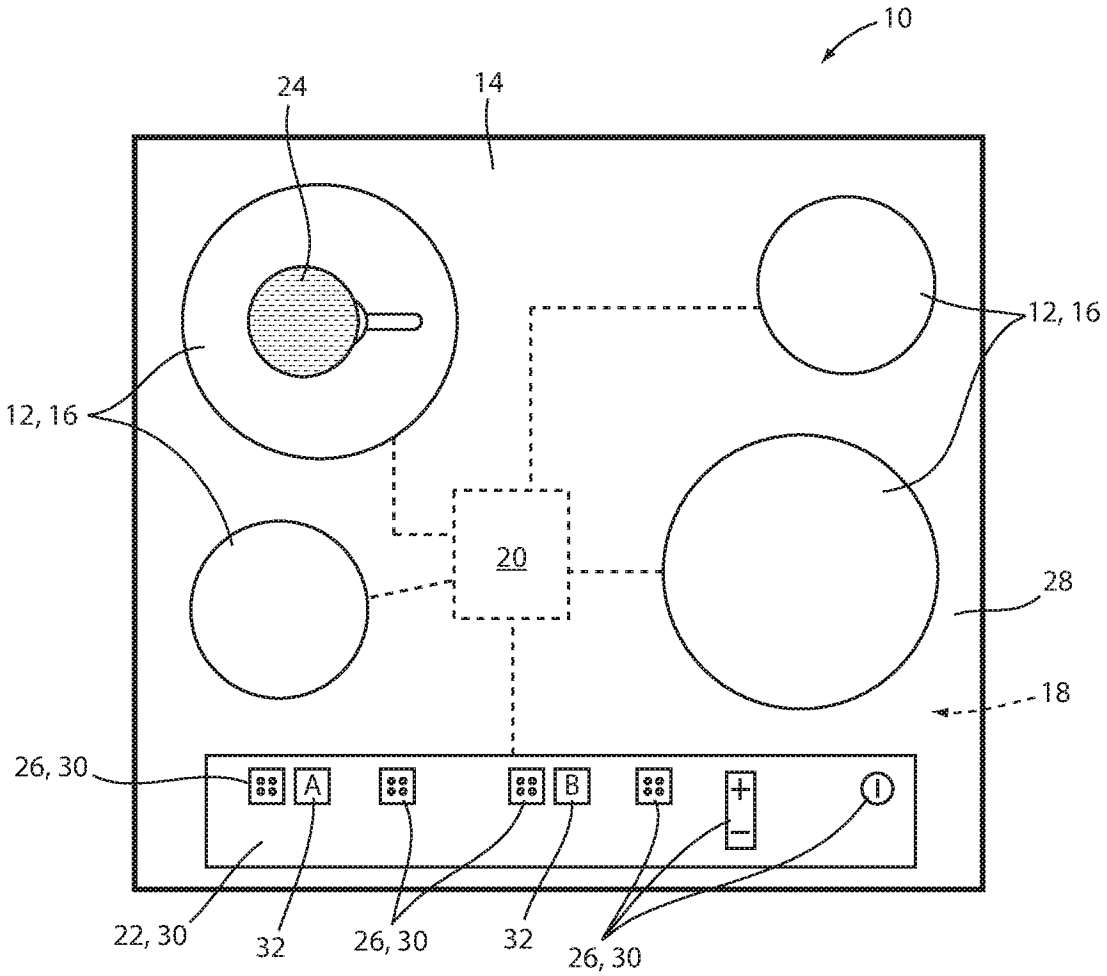
FIG. 1 is a top view of a cooktop according to the present disclosure.

For purposes of description herein, the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Conventional induction cooktops may comprise a top surface made of glass-ceramic material upon which cooking units are positioned (hereinafter "pans"). Induction cooktops operate by generating an electromagnetic field in a cooking region on the top surface. The electromagnetic field is generated by inductors comprising coils of copper wire, which are driven by an oscillating current. The electromagnetic field has the main effect of inducing a parasitic current inside a pan positioned in the cooking region. In order to efficiently heat in response to the electromagnetic field, the pan may be made of an electrically conductive ferromagnetic material. The parasitic current circulating in the pan produces heat by dissipation; such heat is generated only within the pan and acts without directly heating the cooktop.

Induction cooktops have a better efficiency than electric cooktops (i.e. a greater fraction of the absorbed electric power is converted into heat that heats the pan). The presence of the pan on the cooktop causes the magnetic flux close to the pan itself causing the power to be transferred towards the pan. The disclosure provides for a device and method for increasing the performance of a Quasi Resonant inverter that may be used in economical induction cooktops. In particular, the methods and devices proposed increase the regulation range of AC-AC Quasi Resonant (QR) inverters arranged in couples to supply two independent induction pancake coils.

QR inverters or resonant inverters are widely used as AC current generators for induction cooktops. Such inverters, also called Single Ended inverters, are particularly attractive because they only require one solid state switch and only one resonant capacitor to generate a variable frequency/variable amplitude current to feed the induction coil. When properly designed and matched with their load, QR inverters are known to operate in a so called "soft-switching" mode of operation. The soft switching mode operates by a switching device commutating when either the voltage across it and/or the current flowing into it are null. In this sense, QR inverters may provide a reasonable compromise between cost and energy conversion efficiency.

One drawback of QR inverters is that the output power may be limited to a narrow range in the soft-switching mode of operation. In particular, when the output power being regulated falls below a given limit, the inverter fails in operating in a soft switching mode, leading to a dramatic and unmanageable increase in thermal losses and Electromagnetic Interference (a.k.a. EMI). On the other hand, when the power being regulated exceeds a given limit, the resonating voltage across the solid state switch exceeds its maximum rating, leading to instantaneous and irreversible damage of the switching device itself. These two limitations may lead to a relatively low regulation range of the output power. The regulation range is defined as the ratio between a maximum power achievable and the minimum power achievable. The maximum power achievable is limited by a maximum voltage across the switch. The minimum power achievable is limited by a deep loss of a zero voltage switching at turn on.

The aforementioned limitations become exacerbated when multiple inverters are required to operate simultaneously and in synchronized manner. The limitations are compiled when operating two inverters because the frequency interval of allowed operation is reduced to the interval common frequency between the inverters. The common frequency interval is necessarily narrower than the individual frequency interval allowed by each of the individual QR inverters. More often than not, when the impedance of the induction coils are very different than one another, it is impossible to operate the coils simultaneously and at the same frequency without incurring severe inverter overstress. The systems and methods described herein substantially increase both the individual and the joint frequency operating regulation range of a dual QR inverter system without reducing efficiency and while preserving the soft switching operation. For clarity, the QR inverters discussed herein may be referred to as resonant inverters or inverters.

Referring to FIG. 1, a top view of a cooktop 10 is shown. The cooktop 10 may comprise a plurality of cooking hobs 12 oriented on a ceramic plate 14. Beneath the ceramic plate 14 and corresponding to each of the hobs 12, a plurality of induction coils 16 may be disposed in a housing 18. The induction coils 16 may be in communication with a controller 20 configured to selectively activate the induction coils 16 in response to an input to a user interface 22. The controller 20 may correspond to a control system configured to activate one or more of the induction coils 16 in response to an input or user selection. The induction coils 16 may each comprise a driving circuit controlled by the controller 20 that utilizes a switching device (e.g. a solid state switch) to generate a variable frequency/variable amplitude current to feed the induction coils 16. In this configuration, the induction coils 16 are driven such that an electromagnetic field is generated to heat a pan 24. Further discussion of the driving circuits of the induction coils 16 is provided in reference to FIGS. 2-4.

The user interface 22 may correspond to a touch interface configured to perform heat control and selection of the plurality of hobs 12 as represented on a cooking surface 28 of the cooktop 10. The user interface 22 may comprise a plurality of sensors 30 configured to detect a presence of an object, for example a finger of an operator, proximate thereto. The sensors 30 may correspond to any form of sensors. In an exemplary embodiment, the sensors 30 may correspond to capacitive, resistive, and/or optical sensors. In an exemplary embodiment, the sensors 30 correspond to capacitive proximity sensors.

The user interface 22 may further comprise a display 32 configured to communicate at least one function of the cooktop 10. The display 32 may correspond to various forms of displays, for example, a light emitting diode (LED) display, a liquid crystal display (LCD), etc. In some embodiments, the display 32 may correspond to a segmented display configured to depict one or more alpha-numeric characters to communicate a cooking function of the cooktop 10. The display 32 may further be operable to communicate one or more error messages or status messages of the cooktop 10.

Figure 2:
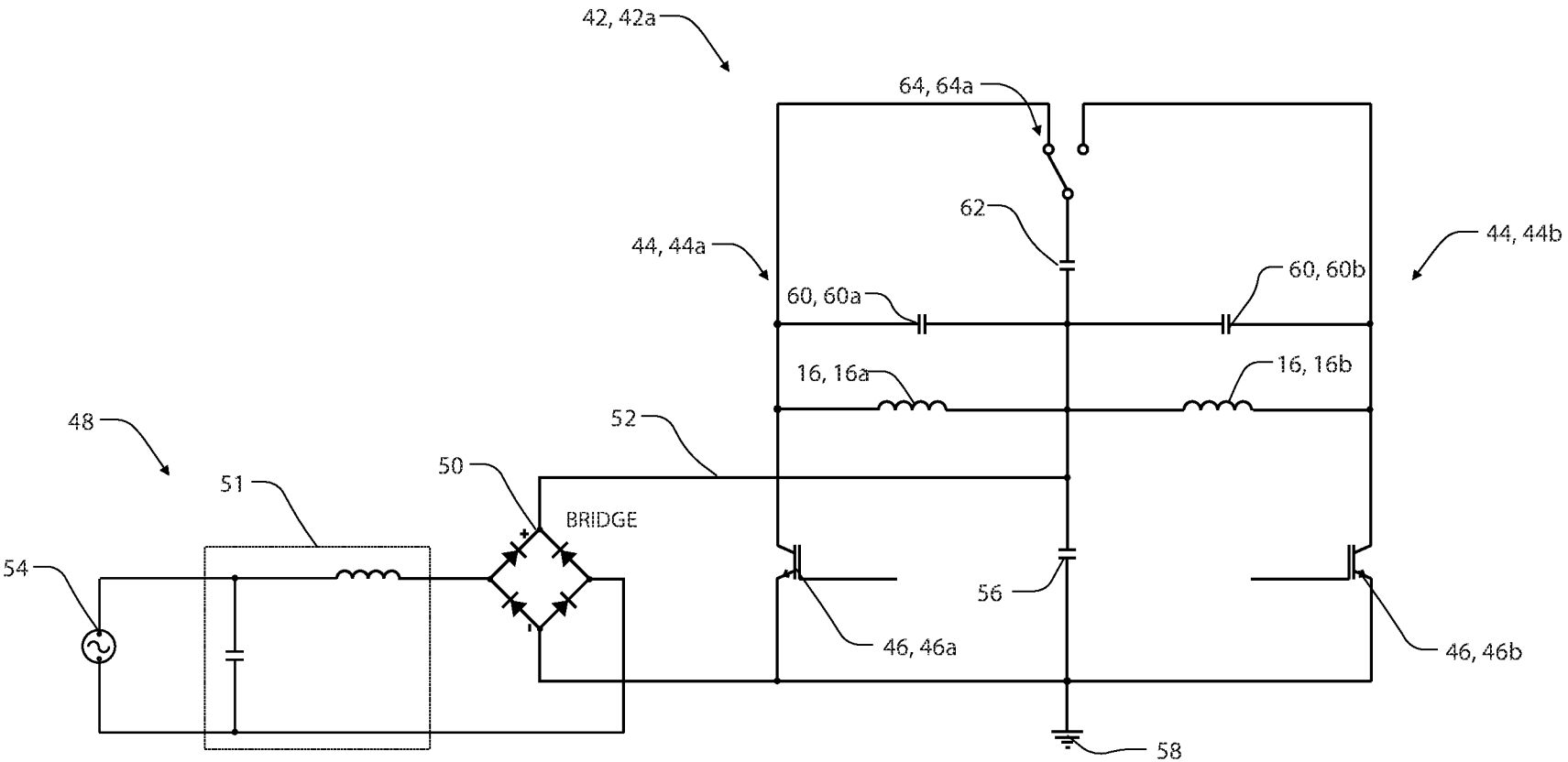
FIG. 2 is a schematic representation of an exemplary embodiment of a driving circuit for an induction cooking system.
Figure 3:
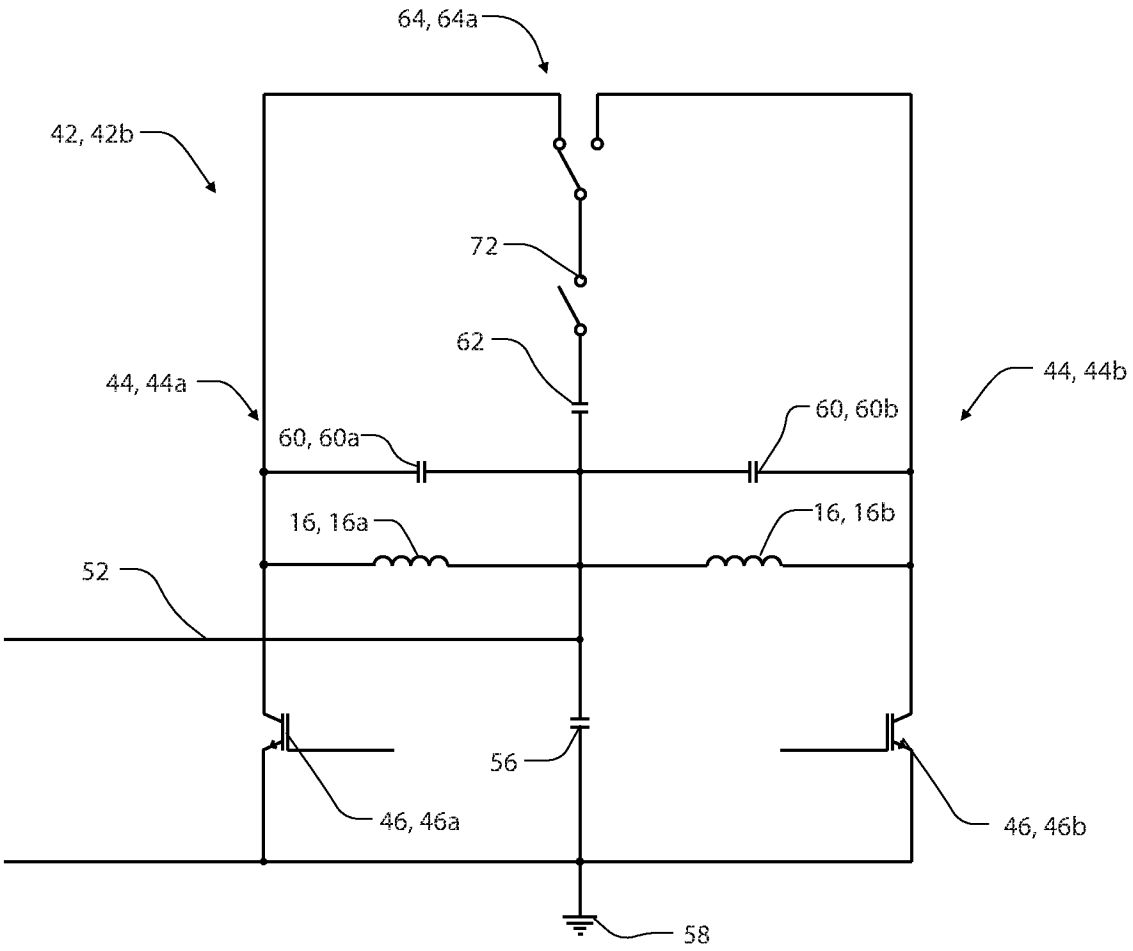
FIG. 3 is a schematic representation of an exemplary embodiment of a driving circuit for an induction cooking system.
Figure 4:
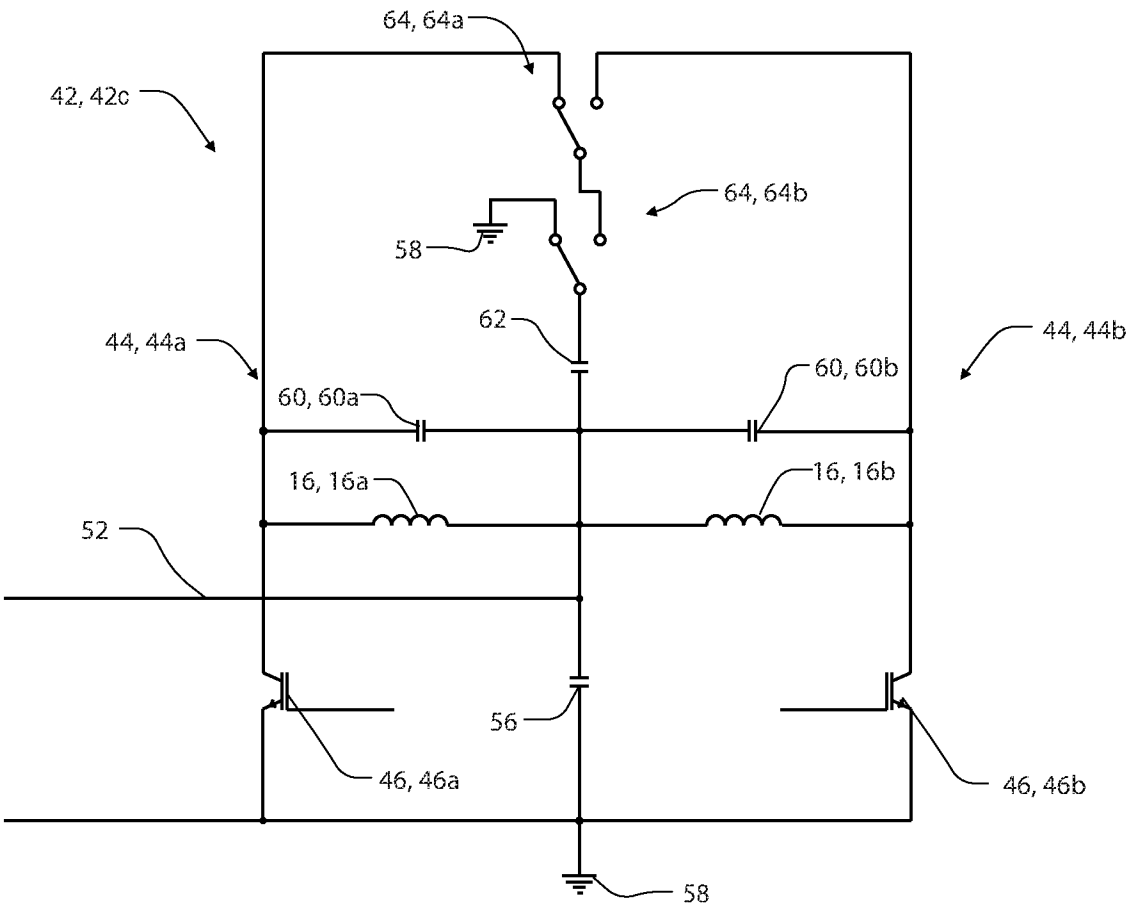
FIG. 4 is a schematic representation of an exemplary embodiment of a driving circuit for an induction cooking system.

Referring now to FIGS. 2-4, a schematic view of a driving circuit 42 is shown. In order to identify specific exemplary aspects of the driving circuits 42, the various embodiments of the driving circuits 42 are referred to as a first driving circuit 42*a* demonstrated in FIG. 2, a second driving circuit 42*b* demonstrated in FIG. 3, and a third driving circuit 42*c* demonstrated in FIG. 4. For common elements, each of the specific exemplary embodiments may be referred to as the driving circuit 42. Though specific features are discussed in reference to each of the first, second, and third driving circuits, each of the embodiments may be modified based on the combined teachings of the disclosure without departing from the spirit of the disclosure.

The driving circuit 42 comprises a plurality of inverters 44 configured to supply driving current to a first induction coil 16*a* and a second induction coil 16*b*. The inverters 44 may correspond to resonant or QR inverters and each may comprise a switching device 46 (e.g. a first switching device 46*a* and a second switching device 46*b*). The switching devices 46 may correspond to solid state power switching devices, which may be implemented as an insulated-gate bipolar transistor (IGBT). The switching devices 46 may be supplied power via a direct current (DC) power supply 48 and may be controlled via a control signal supplied by the controller 20. In this configuration, the controller 20 may selectively activate the induction coils 16 by controlling a switching frequency supplied to the switching devices 46 to generate the electromagnetic field utilized to heat the pan 24. As discussed in the following detailed description, each of the driving circuits 42 may provide for an increased range in a switching frequency ($f_{SW}$) of the plurality of inverters 44 to drive the induction coils 16. The induction coils 16 may correspond to independent induction coils or independent pancake coils.

The DC power supply 48 may comprise a bridge rectifier 50 and an input filter 51 configured to supply DC voltage to a DC-bus 52 from an alternating current (AC) power supply 54. In this configuration, the current DC-bus 52 may be conducted to the inverters 44 across a DC-bus capacitor 56 separating the DC-bus 52 from a ground 58 or ground reference node. In this configuration, the DC power supply 48 may be configured to rectify periodic fluctuations in the AC power to supply DC current to the inverters 44. The DC power supply 48 may be commonly implemented in each of the exemplary driving circuits 42 demonstrated in FIG. 2 and is omitted from FIGS. 3 and 4 to more clearly demonstrate the elements of the driving circuits 42.

Still referring to FIGS. 2-4, the first inverter 44*a* and the second inverter 44*b* are in conductive connection with the DC-Bus 52 of the DC power supply 48. The first inverter 44*a* may comprise a first dedicated resonant capacitor 60*a* and the first induction coil 16*a*. The first dedicated resonant capacitor 60*a* may be connected in parallel with the first induction coil 16*a* from the DC-bus 52 to the first switching device 46*a*. The second inverter 44*b* comprises a second dedicated resonant capacitor 60*b* and the second induction coil 16*b*. The second dedicated resonant capacitor 60*b* may be connected in parallel with the second induction coil 16*b* from the DC-bus 52 to the second switching device 46*b*. In an exemplary embodiment, the dedicated resonant capacitors 60 are dimensioned to establish the resonance in a desired frequency range in conjunction with a third resonant capacitor that may be selectively connected in parallel with either the first dedicated resonant capacitor 60*a* or the second dedicated resonant capacitor 60*b*. The third resonant capacitor may be referred to herein as a tuning capacitor 62. Examples of frequency ranges for operation of the inverters 44 are discussed further in reference to FIGS. 5 and 6.

The tuning capacitor 62 may be selectively connectable in parallel with either the first dedicated resonant capacitor 60*a* or the second dedicated resonant capacitor 60*b* via a two-way switch 64. For example, the controller 20 of the cooktop 10 may be configured to control the switch 64 to a first switch configuration conductively connecting the tuning capacitor 62 in parallel with the first dedicated resonant capacitor 60*a* and the first induction coil 16*a*. The first switch configuration as discussed herein is demonstrated in FIG. 2. The controller 20 may further be configured to control the switch 64 to a second switch configuration conductively connecting the tuning capacitor 62 in parallel with the second dedicated resonant capacitor 60*b* and the second induction coil 16*b*. In this way, the driving circuit 42*a* may be operable to selectively shift the operating frequency range supplied to a load of the first induction coil 16*a* or the second induction coil 16*b*.

Referring now to FIG. 3, in some embodiments, the driving circuit 42*b* may comprise a second switch or a relay switch 72. The relay switch 72 may be configured to selectively disconnect the tuning capacitor 62 from the inverters 44. In this configuration, the controller 20 may be configured to control the two-way switch 64 and the relay switch 72. Accordingly, the controller 20 may be configured to control the two-way switch 64 to a first switch configuration conductively connecting the tuning capacitor 62 in parallel with the first dedicated resonant capacitor 60*a* and the first induction coil 16*a*. The controller 20 may further be operable to control the two-way switch 64 to a second switch configuration conductively connecting the tuning capacitor 62 in parallel with the second dedicated resonant capacitor 60*b* and the second induction coil 16*b*. Finally, the controller 20 may control the relay switch 72 to selectively disconnect the tuning capacitor 62 from both of the first inverter 44*a* and the second inverter 44*b*.

Referring now to FIG. 4, in yet another embodiment, the driving circuit 42*c* may comprise a first two-way switch 64*a* and a second two-way switch 64*b*. The controller 20 may control the first two-way switch 64*a* to selectively shift the operating frequency of the first inverter 44*a* and the second inverter 44*b* as discussed in reference to FIGS. 2 and 3. Additionally, the second two-way switch 64*b* may be connected between the tuning capacitor 62 and the first two-way switch 64*a*. The second two-way switch 64*b* may be configured to selectively connect the tuning capacitor 62 to the first two-way switch 64*a* in a first switching configuration. Additionally, the second two-way switch 64*b* may be configured to selectively connect the tuning capacitor 62 to the ground 58 in parallel with the DC-bus capacitor 56 in a second switching configuration.

In operation, the controller 20 may control the second two-way switch 64*b* to selectively connect the tuning capacitor 62 to the first two-way switch 64*a* in the first switch configuration. Additionally, the controller 20 may control the second two-way switch 64*b* to selectively connect the tuning capacitor 62 to the ground 58. By connecting the tuning capacitor 62 to the ground 58 in parallel with the DC-bus capacitor 56, the controller 20 may limit electromagnetic interference (EMI). Accordingly, the various configurations of the driving circuits 42 may provide for improved operation of the induction cooktop 10.

Figure 5:
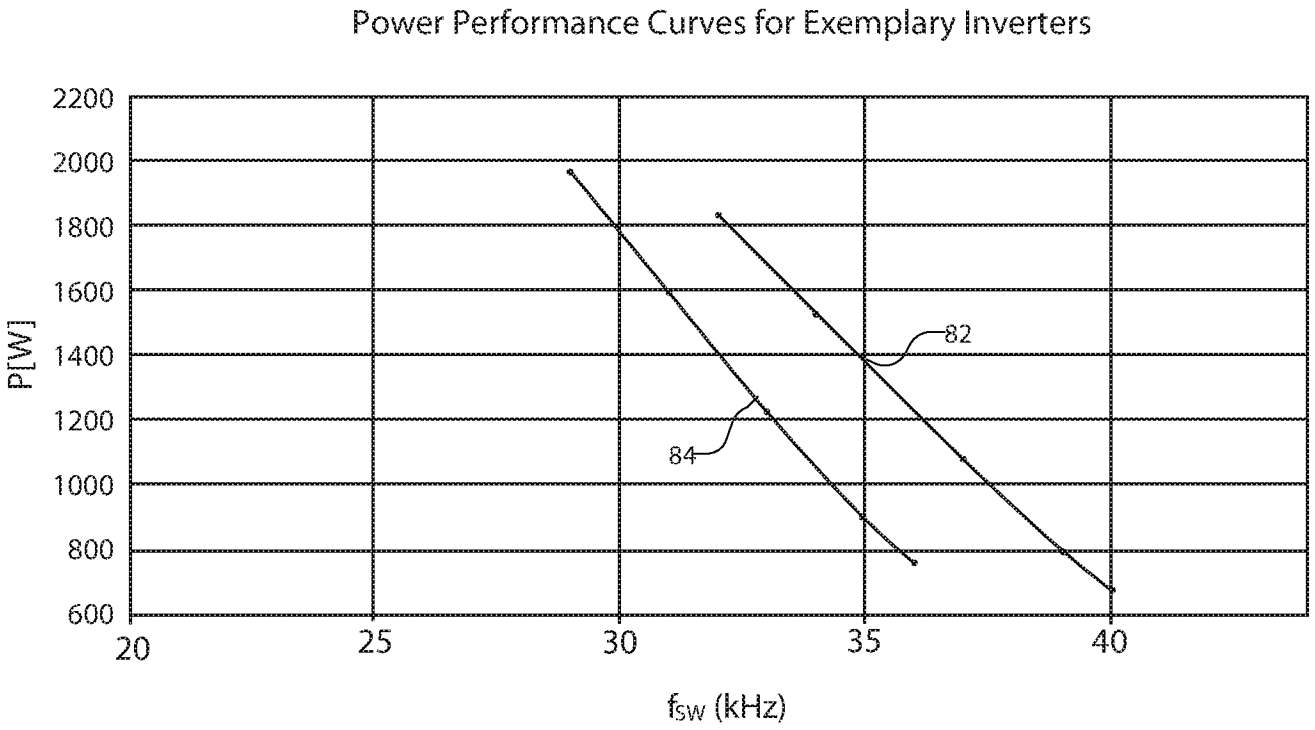
FIG. 5 is a plot of a system response of an exemplary embodiment of an inverter.

Referring now to FIG. 5, a plot of power generated by an exemplary embodiment of the inverter 44 is shown. The plot demonstrates the performance of the inverter 44 with two different values of the dedicated resonant capacitor 60 and similar loads (e.g. the pan 24). The plot demonstrates the power generated by two different exemplary inverter configurations to a range of switching frequencies ($f_{SW}$). For example, the power output range of the inverter 44 is shown over a first operating range 82 for the dedicated resonant capacitor 60 having a capacitance of 270 nF. For comparison, the power output range of the inverter 44 is shown over a second operating range 84 for the dedicated resonant capacitor 60 having a capacitance of 330 nF.

As demonstrated in FIG. 5, the first operating range 82 corresponds to a comparatively lower capacitance and varies from a power output of 674 W at a switching frequency ($f_{SW}$) of 40 kHz to 1831 W at $f_{SW}$=32 kHz. The second operating range 84 corresponds to a comparatively higher capacitance and varies from a power output of 758 W at $f_{SW}$=36 kHz to 1964 W at $f_{SW}$=29 kHz. Accordingly, increasing the capacitance of the dedicated resonant capacitor 60 of the inverter 44 may provide for a shift lower than the operating range of the switch frequency ($f_{SW}$) while increasing the power output. These principles may similarly be applied to adjust the operating range and power output of the exemplary inverters 44 of the driving circuits 42 by adjusting the effective capacitance with the tuning capacitor 62 to suit a desired mode of operation.

Figure 6:
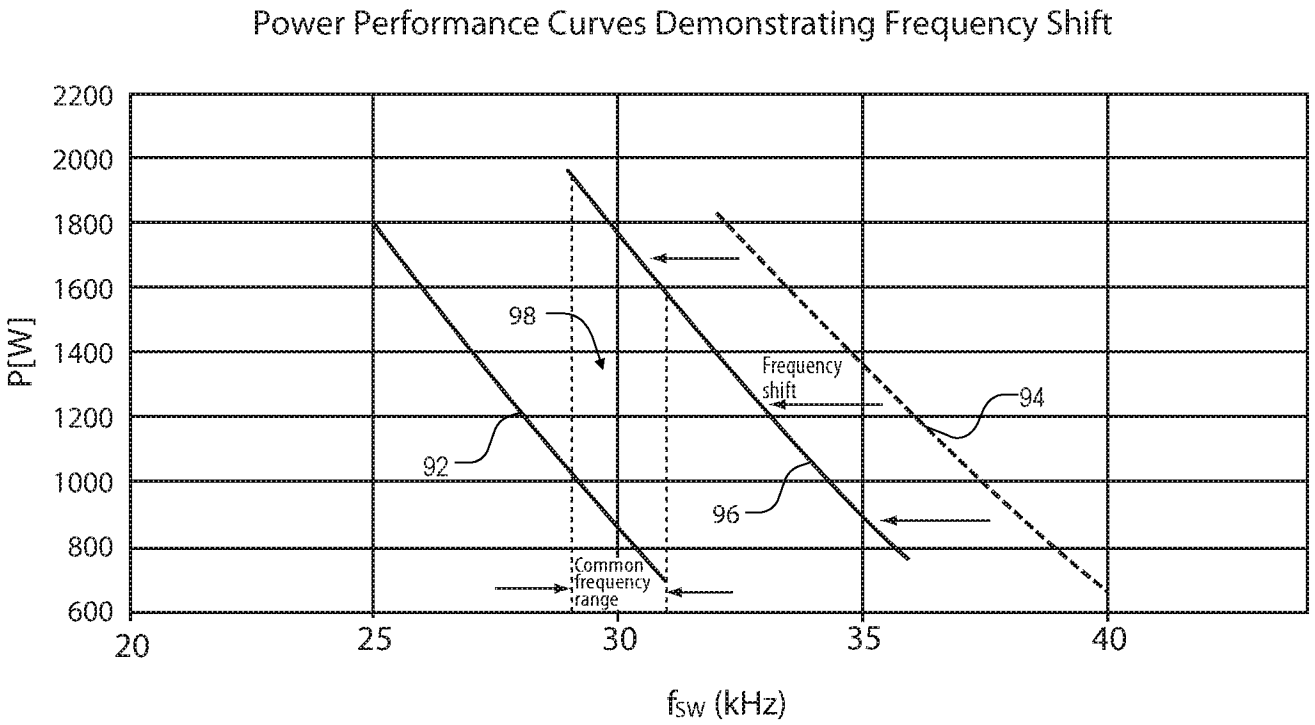
FIG. 6 is a plot of a power generated by two different resonant capacitors over a range of switching frequencies demonstrating a shift in an operating frequency.

Referring now to FIG. 6, a system response of the driving circuit 42 resulting from a frequency shift caused by adding the tuning capacitor 62 is shown. As previously discussed, the controller 20 may selectively connect the tuning capacitor 62 in parallel to either the first inverter 44*a* or the second inverter 44*b*. As previously discussed, the tuning capacitor 62 may be added in parallel to either the first dedicated resonant capacitor 60*a* or the second dedicated resonant capacitor 60*b* by the controller 20. Depending on the particular embodiment or the driving circuit 42, the controller 20 may add the tuning capacitor 62 in parallel by controlling the first two-way switch 64*a* in combination with either the second two-way switch 64*b* or the relay switch 72. Accordingly, the controller 20 may be configured to selectively adjust an operating frequency range of either the first inverter 44*a* or the second inverter 44*b*.

In operation, the operating frequency of each of the inverters may not only differ based on the design of the inverters 44 but also in response to load changes or differences in the diameter, magnetic permeability and conductivity of the conductive ferromagnetic material of the pans or cooking accessories on the cooktop 10. In the exemplary embodiment shown in FIG. 6, each of the first inverter 44*a* and the second inverter 44*b* comprises a dedicated resonant capacitor 60 of 270 nF. However, due to differences in load on each of the induction coils 16 and other variables, the operating ranges differ significantly. For example, in the exemplary embodiment, the first inverter 44*a* has a first operating range 92 that varies from 710 W at $f_{SW}$=30.8 kHz to 1800 W at $f_{SW}$=25 kHz. The second inverter 44*b* has a second operating range 94 that varies from 670 W at $f_{SW}$=40 kHz to 1825 W at $f_{SW}$=32.3 kHz. Note that neither the first operating range 92 nor the second operating range 94 provide for soft-switching operation between 30.8 kHz and 32.3 kHz and do not overlap in the operating range of the switching frequency ($f_{SW}$).

During operation it may be advantageous to limit intermodulation acoustic noise. However, as demonstrated, the first operating range 92 and the second operating range 94 do not have an overlapping range of operation in the soft-switching region. However, by adjusting the effective capacitance of the second dedicated resonant capacitor 60*b* by adding the tuning capacitor 62 in parallel, the second operating range 94 is shifted to an adjusted operating range 96. Though discussed in reference to shifting the second operating range 94 of the second inverter 44*b*, the controller 20 may be configured to similarly shift the first operating range 92 of the first inverter 44*a*. In general, the controller 20 may identify the higher operating range of the switch frequency ($f_{SW}$) of the first inverter 44*a* and the second inverter 44*b* and control at least one of the switches (e.g. 64*a*, 64*b*, and 72) to apply the tuning capacitor 62 in parallel with the corresponding dedicated resonant capacitor (e.g. 60*a* or 60*b*). In this way, the controller 20 may shift the operating range of the first inverter to at least partially overlap with the operating range of the second inverter.

Still referring to FIG. 6, the adjusted operating range 96 varies from approximately 750 W at 36 kHz to 1960 W at 29 kHz. Accordingly, the first operating range 92 of the first inverter 44*a* and the adjusted operating range 96 of the second inverter 44*b* may provide for a common frequency range 98. In this configuration, the controller 20 may control each of the inverters 44 with the same switching frequency within the common frequency range 98 to achieve simultaneous operation while limiting acoustic noise. The effects of applying the tuning capacitor 62 to the inverters 44 are summarized in Table 1.

TABLE 1

Performance changes resulting from applying tuning capacitor 62

| Switch Configuration | Frequency Range | $P_{max}$ | $P_{min}$ |
|---|---|---|---|
| Dedicated Resonant Capacitor | Shift Upward (increase) | Decrease | Decrease |

TABLE 1-continued

Performance changes resulting from applying tuning capacitor 62

| Switch Configuration | Frequency Range | $P_{max}$ | $P_{min}$ |
|---|---|---|---|
| Dedicated Resonant Capacitor with Tuning Capacitor | Shift Downward (decrease) | Increase | Increase |

From Table 1, the performance changes of the inverter 44 with and without the tuning capacitor 62 are summarized. In response to the tuning capacitor 62 being added in parallel with the dedicated resonant capacitor 60, the range of the switching frequency ($f_{SW}$) is shifted downward or decreased. Additionally, the maximum power ($P_{max}$) output from the inverter 44 increases and the minimum power ($P_{min}$) increases. In this way, the controller 20 may control at least one of the switches (e.g. 64*a*, 64*b*, and 72) to adjust the operating range of one of the inverters 44. In some cases, the shifting of the operating range may provide for the common frequency range 98 of the inverters 44 to achieve simultaneous operation while limiting acoustic noise.

Accordingly, based on the first operating range 92, the second operating range 94, and the adjusted operating range 96, the controller 20 may be configured to control the inverters 44 to operate within their respective operating ranges. For example, in the case that only one of the two inverters 44 is active, the controller 20 may be configured to connect the tuning capacitor 62 to the corresponding induction coil 16 (e.g. 16*a* or 16*b*). The controller 20 may connect the tuning capacitor 62 via the first two-way switch 64*a* if a set-point power of an operating range (e.g. 92 or 94) exceeds the maximum power deliverable by that inverter (44*a* or 44*b*) with only the dedicated resonant capacitor (60*a* or 60*b*). Otherwise, when the set-point power of the inverters 44 are within the operating ranges (92 or 94), the controller 20 may disconnect the tuning capacitor 62 by controlling the second two-way switch 64*b* or the relay switch 72.

In the case where both inverters 44 are required to deliver power simultaneously, the controller 20 may connect the tuning capacitor 62 to one of the induction coils 16 such that the first inverter 44*a* and the second inverter 44*b* have the common operating frequency range 98. For example, the controller 20 may connect the tuning capacitor 62 in parallel with the second inverter 44*b*. Accordingly, the first operating range 92 of the first inverter 44*a* and the adjusted operating range 96 of the second inverter 44*b* may provide for the common frequency range 98. In this configuration, the controller 20 may control each of the inverters 44 with the same switching frequency within the common frequency range 98 to achieve simultaneous operation while limiting acoustic noise. Finally, in the case where both inverters 44 are required to deliver power simultaneously and the operating frequency ranges 92 and 94 already include an overlapping frequency range, the controller 20 may disconnect the tuning capacitor 62 by controlling the second two-way switch 64*b* or the relay switch 72.

Figure 7:
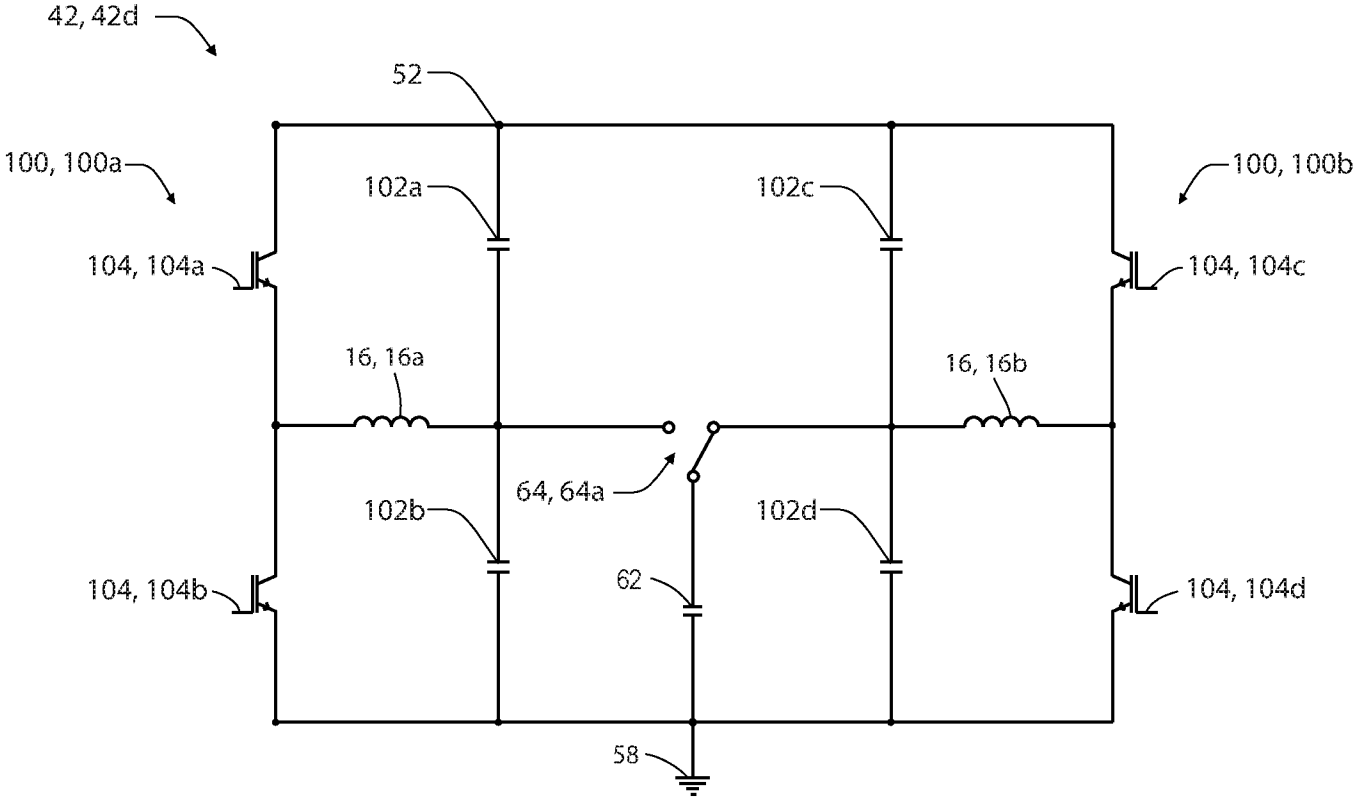
FIG. 7 is a schematic representation of an exemplary embodiment of a driving circuit for an induction cooking system in accordance with the disclosure.

Referring now to FIG. 7, a diagram of yet another embodiment of a driving circuit 42, 42*d* for a cooktop 10 is shown. The driving circuit 42*d* may comprise a plurality of half-bridge, series resonant inverters 100. For example, the driving circuit 42*d* may comprise a first series resonant inverter 100*a* and a second series resonant inverter 100*b*. The first series resonant inverter 100*a* may comprise the first induction coil 16*a* and a plurality of dedicated resonant capacitors 102*a* and 102*b*. Additionally, the first series resonant inverter 100*a* may comprise a plurality of switching devices 104 (e.g. a first switching device 104*a* and a second switching device 104*b*). The first switching device 104*a* may be connected from the DC-bus 52 to a first side of the first induction coil 16*a*. The second switching device 104*b* may be connected from the ground 58 to the first side of the first induction coil 16*a*. A first dedicated capacitor 102*a* may be connected from the DC-bus 52 to a second side of the first induction coil 16*a*. Additionally, a second dedicated capacitor 102*b* may be connected from the ground 58 to the second side of the first induction coil 16*a*.

The second series resonant inverter 100*b* may comprise the second induction coil 16*b* and a plurality of dedicated resonant capacitors 102*c* and 102*d*. The second series resonant inverter 100*b* may further comprise a plurality of switching devices 104 (e.g. a third switching device 104*c* and a fourth switching device 104*d*). The third switching device 104*c* may be connected from the DC-bus 52 to a first side of the second induction coil 16*b*. The fourth switching device 104*d* may be connected from the ground 58 to the first side of the second induction coil 16*b*. A third dedicated capacitor 102*c* may be connected from the DC-bus 52 to a second side of the second induction coil 16*b*. Additionally, a fourth dedicated capacitor 102*d* may be connected from the ground 58 to the second side of the second induction coil 16*b*.

The switching devices 104 may correspond to solid state power switching devices, similar to the switching devices 104, which may be implemented as an insulated-gate bipolar transistor (IGBT). The switching devices 104 may be supplied power via DC-bus 52 of the DC power supply 48 and may be controlled via a control signal supplied by the controller 20. In this configuration, the controller 20 may selectively activate the induction coils 16 by controlling a switching frequency supplied to the switching devices 104 to generate the electromagnetic field utilized to heat the pan 24.

The tuning capacitor 62 may be selectively connected to the second side of the first induction coil 16*a* or connected to the second side of the second induction coil 16*b* by the two-way switch 64. For example, in a first configuration, the switch 64 may connect the tuning capacitor 62 in parallel with the second dedicated capacitor 102*b*. In a second configuration, the switch 64 may connect the tuning capacitor 62 in parallel with the fourth dedicated capacitor 102*d*. Accordingly, the driving circuit 42*d* may be operable to selectively shift the operating frequency range supplied to a load of the first induction coil 16*a* or the second induction coil 16*b* by controlling the switch 64.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An induction cooking system, comprising:

a power supply bus;

a plurality of resonant inverters in connection with the power supply bus, each comprising a dedicated resonant capacitor;

at least one bus capacitor in connection with each of the dedicated resonant capacitors and a ground;

a plurality of inductors configured to generate an electromagnetic field in connection with the plurality of resonant inverters;

at least one switch operable to control a plurality of switch configurations comprising a first configuration and a second configuration; and a tuning capacitor in connection with each of the dedicated resonant capacitors via the at least one switch, wherein the at least one switch is configured to selectively connect the tuning capacitor in parallel with one of the dedicated resonant capacitors in the first configuration and the second configuration.

2. The induction cooking system according to claim 1, wherein the switch is conductively connected to the tuning capacitor and configured to selectively connect to each of the dedicated resonant capacitors of the resonant inverters.

3. The induction cooking system according to claim 1, wherein the resonant inverters each comprise a switching device in connection with each of the dedicated resonant capacitors and the inductors.

4. The induction cooking system according to claim 1, wherein the at least one switch comprises a plurality of switches.

5. The induction cooking system according to claim 4, wherein the plurality of switches comprises a first switch configured to conductively connect selectively to each of the dedicated resonant capacitors of the resonant inverters.

6. The induction cooking system according to claim 5, wherein the plurality of switches comprises a second switch arranged in series with the tuning capacitor, wherein the second switch is configured to selectively connect or disconnect the tuning capacitor from the resonant inverters.

7. The induction cooking system according to claim 6, wherein the second switch is further configured to connect the tuning capacitor in parallel with the bus capacitor when the tuning capacitor is disconnected from the resonant inverters.

8. An induction cooking system, comprising:

a power supply bus;

a first resonant inverter, comprising:

a first dedicated resonant capacitor in connection with the power supply bus; and a first induction coil connected in parallel with the first dedicated resonant capacitor;

a second resonant inverter, comprising:

a second dedicated resonant capacitor in connection with the power supply bus; and a second induction coil connected in parallel with the second dedicated resonant capacitor;

at least one switch operable to control a plurality of switch configurations comprising a first configuration and a second configuration, wherein the at least one switch is configured to selectively connect the first dedicated resonant capacitor in parallel with the tuning capacitor in the first configuration and the second dedicated resonant capacitor in parallel with the tuning capacitor in the second configuration; and a tuning capacitor in connection with the first dedicated resonant capacitor and the second dedicated resonant capacitor via the at least one switch, wherein the at least one switch is configured to selectively connect the tuning capacitor in parallel to either the first dedicated resonant capacitor or the second dedicated resonant capacitor in each of the plurality of switch configurations.

9. The induction cooking system according to claim 8, further comprising:

at least one bus capacitor in conductive connection with the first dedicated resonant capacitor, the second dedicated resonant capacitor and a ground.

10. The induction cooking system according to claim 8, wherein the at least one switch comprises a plurality of switches comprising a second switch disposed between the first switch and the tuning capacitor, wherein the second switch is configured to selectively disconnect the first switch from the resonant inverters.

11. An induction cooking system, comprising:

a power supply bus;

a plurality of resonant inverters in connection with the power supply bus, each comprising a dedicated resonant capacitor, the plurality of resonant inverters comprising a first resonant inverter comprising a first dedicated capacitor and a second resonant inverter comprising a second dedicated capacitor;

a plurality of inductors configured to generate an electromagnetic field in connection with the plurality of resonant inverters;

a switch operable to control a plurality of switch configurations comprising a first configuration and a second configuration; and a tuning capacitor in connection with each of the dedicated resonant capacitors via the switch, wherein the switch is configured to connect the tuning capacitor in parallel with either the first dedicated capacitor in the first configuration or the second dedicated capacitor in the second configuration.

12. The induction cooking system according to claim 11, wherein the switch is conductively connected to the tuning capacitor and configured to selectively connect to each of the dedicated resonant capacitors of the resonant inverters.

13. The induction cooking system according to claim 11, further comprising:

at least one bus capacitor in connection with each of the dedicated resonant capacitors and a ground.

14. The induction cooking system according to claim 11, wherein the resonant inverters each comprise a switching device in connection with each of the dedicated resonant capacitors and the inductors.

* * * * *